US005819979A

United States Patent [19]

Murphy et al.

[11] Patent Number: 5,819,979

[45] Date of Patent: Oct. 13, 1998

[54] BEVERAGE CONTAINER WITH SELF-CONTAINED DRINKING STRAW

[75] Inventors: Peter F. Murphy, Grosse Pointe, Mich.; Doug Brewer, Chicago, Ill.; Dave Brown, Chicago, Ill.; Jon Taylor, Chicago, Ill.; Paul Doczy, Chicago, Ill.

[73] Assignee: The PopStraw Company, LLC, Eastpointe, Mich.

[21] Appl. No.: 856,838

[22] Filed: May 15, 1997

[51] Int. Cl.[6] ..... B65D 47/06

[52] U.S. Cl. ..... 220/706; 220/707; 215/388

[58] Field of Search ..... 220/705, 706, 220/709, 710, 707; 215/388, 389

[56] References Cited

U.S. PATENT DOCUMENTS

| | | |
|---|---|---|
| 3,263,855 | 8/1966 | Pugh, Sr. . |
| 3,295,715 | 1/1967 | Pugh . |
| 3,349,955 | 10/1967 | Cornelius . |
| 3,547,308 | 12/1970 | Gillieon . |
| 3,656,654 | 4/1972 | Brinkley, III . |
| 3,717,476 | 2/1973 | Harvey . |
| 3,746,197 | 7/1973 | Sather . |
| 3,776,458 | 12/1973 | Chunga . |
| 3,946,895 | 3/1976 | Pugh . |
| 4,078,692 | 3/1978 | Stein . |
| 4,109,817 | 8/1978 | Payne et al. . |
| 4,226,356 | 10/1980 | Lemelson . |
| 4,228,913 | 10/1980 | Mack et al. . |
| 4,305,521 | 12/1981 | Komatsuta et al. . |
| 4,356,927 | 11/1982 | Cooper et al. . |
| 4,424,913 | 1/1984 | Ko . |
| 4,462,503 | 7/1984 | DeRaffaele et al. . |
| 4,537,324 | 8/1985 | Wang . |
| 4,561,557 | 12/1985 | Park et al. . |
| 4,582,213 | 4/1986 | Park et al. . |
| 4,690,294 | 9/1987 | Jones . |
| 4,709,829 | 12/1987 | Johnson et al. . |
| 4,712,702 | 12/1987 | Ayabe et al. . |
| 4,728,001 | 3/1988 | Serba . |
| 4,826,034 | 5/1989 | Forbes . |
| 4,842,157 | 6/1989 | Stone-Parker et al. . |
| 4,877,148 | 10/1989 | Larson et al. . |
| 4,892,187 | 1/1990 | Stein . |
| 4,923,083 | 5/1990 | Forbes . |
| 4,923,084 | 5/1990 | Forbes . |
| 4,925,040 | 5/1990 | Wang . |
| 4,930,652 | 6/1990 | Murphy et al. . |
| 4,948,008 | 8/1990 | Wu et al. . |
| 5,054,639 | 10/1991 | Ahn . |
| 5,160,058 | 11/1992 | Ahn . |
| 5,172,827 | 12/1992 | Chang et al. . |
| 5,253,779 | 10/1993 | Lee . |
| 5,547,103 | 8/1996 | Murphy et al. . |

FOREIGN PATENT DOCUMENTS

| | | |
|---|---|---|
| WO 85/04850 | 11/1985 | European Pat. Off. . |
| 2590237 A | 11/1985 | France . |
| 2615487 | 11/1988 | France . |
| 2627753 | 9/1989 | France . |
| 2650488 A1 | 5/1978 | Germany . |
| 3-98877 | 4/1991 | Japan . |
| 4-44955 | 2/1992 | Japan . |
| 4-72149 | 3/1992 | Japan . |

*Primary Examiner*—Stephen J. Castellano
*Attorney, Agent, or Firm*—Harness, Dickey & Pierce, P.L.C.

[57] ABSTRACT

A beverage container has a straw-dispensing mechanism that is disposed within the container to bring the straw into alignment with the orifice in the top of the container. When the orifice is opened, the straw elevates through the orifice to become accessible to the user. In one embodiment, the straw is attached to a buoyant member which urges the straw into contact with a contoured surface on the can lid. The contoured surface is angled towards the orifice. In a second embodiment, the straw engages a floating member which is urged against the lid of the container. When the container is opened by deflecting a closure tab into the container, the closure tab engages a cam surface on the floating member and imparts rotational motion to the floating member. The floating member rotates until the straw is aligned with the open orifice and a buoyant member associate with on the straw elevates the straw through the orifice.

16 Claims, 4 Drawing Sheets

BEVERAGE CONTAINER WITH SELF-CONTAINED DRINKING STRAW

FIELD OF THE INVENTION

The present invention relates to beverage containers having a self-contained straw. More particularly, the present invention relates to beverage containers having a self-contained straw which becomes accessible to the user when the beverage container is opened.

BACKGROUND AND SUMMARY OF THE INVENTION

Currently, beverage containers are manufactured, filled, and sealed in a high-speed automated process. This process includes manufacturing a separate body for containing the fluid or beverage and a separate lid for sealing the open end of the body. During manufacture of the filled beverage container, a manufacturing operation known as "seaming" places the lid on a filled can body and seals its perimeter. At present, known seaming operations pass the lids horizontally across the top of the filled can bodies at a vertical distance of only a few millimeters above the top edge of the can body. Once positioned on top of the can body, the seaming operation seals the fluid or beverage within the beverage container. This seaming operation involves the use of very expensive high-speed machinery and tooling or retooling this high-speed machinery to accommodate a self-contained drinking straw is not a practical solution.

Various designs have been proposed in the prior art for placing a straw within a beverage can that becomes accessible to the user when the tab in the lid of the can is deflected into the interior to open the can. The vast majority of these designs can be categorized into two groups. The first group comprises designs wherein the straw is installed within the can so as to be prealigned with the tab opening. Thus, when the tab is opened, access to the straw is presented. The practical disadvantage with this approach is that the bodies and lids of the cans are randomly oriented during the present day seaming operations. Consequently, any design that requires prealignment of the straw with the opening in the lid is not readily adaptable to the existing high-speed filling equipment.

The second group of designs generally involves the mounting or attachment in some manner of the straw to the underside of the lid such that when the can is opened, the end of the straw is drawn through or otherwise made accessible through the opening. These designs are also not readily adaptable to the existing high-speed filling canning equipment due to the fact, as noted above, the commercial filling processes pass the lid within a few millimeters of the top of the can during the high-speed seaming operation. Consequently, any structure that is attached or otherwise appended to the underside of the lid will disrupt the seaming process and thus require expensive retooling of the existing high-speed machinery.

A different approach for this concept is disclosed in U.S. Pat. No. 5,547,103 which is assigned to the assignee of the present invention. This patent discloses various embodiments of a beverage container having a straw-dispensing mechanism that relies upon user manipulation of the container and the forces of gravity to bring the straw into alignment with the opening in the lid. The user merely tilts the beverage container, preferably prior to opening, to cause the mechanism within the container to bring the straw into general alignment with the tab. Once the container is opened, further minor manipulation or tilting of the container may be necessary to complete the alignment of the straw with the open orifice in the lid.

Yet another approach for this concept is disclosed in U.S. Pat. Nos. 5,244,112; 5,080,247 and 4,930,652 which are also assigned to the assignee of the present invention. These patents describe various embodiments of a straw-dispensing mechanism that is disposed within the body of the container which operate to rotate the straw into alignment beneath the open orifice of a beverage container. IN particular, these designs respond to the inward deflection of the closure tab into the body of the container to actuate or drive a rotating mechanism which aligns the straw with the open orifice. While these designs remain technologically and commercially viable, the continued development of straw-dispensing mechanisms is directed to simpler and lower cost mechanisms which can be relied upon to consistently align the drinking straw with the open orifice in the beverage can once the orifice in the beverage can has been opened.

In this regard, the present invention discloses a beverage container having a straw-dispensing mechanism which includes a contoured or shaped cam surface which operates to cause rotation of the drinking straw to align the drinking straw with the orifice. A first embodiment of the present invention employs a float which supports and positions the drinking straw at a distance radially which is equal to the radial position of the orifice in the can lid. A contoured or cam surface located on the interior surface of the lid of the can guides the drinking straw into alignment with the orifice in the can.

A second embodiment employs a float which supports and positions the drinking straw at a distance radially which is equal to the radial position of the orifice in the can lid. A contoured or cam surface located on the upper surface of the float reacts with the inward deflected tab upon opening of the beverage can to rotate the drinking straw to a position in alignment with the now open orifice.

Thus, it is an object of the present invention to provide a beverage container with a self-contained straw-dispensing mechanism that is compatible for manufacture with existing filling equipment.

In addition, it is an object of the present invention to provide such a beverage container with a self-contained straw-dispensing mechanism that is simple in design, utilizes a minimum of material, is inexpensive to manufacture, and requires relatively inexpensive equipment to assemble and insert into the beverage containers.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
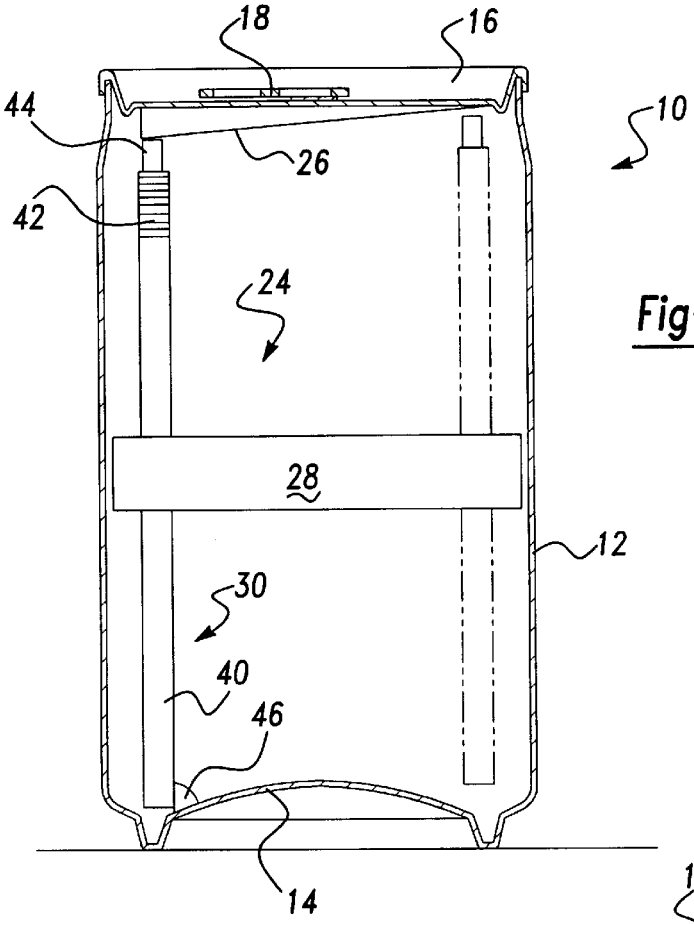
FIG. 1 is a vertical sectional view of a beverage can containing a straw-dispensing mechanism according to a first embodiment of the present invention.
Figure 2:
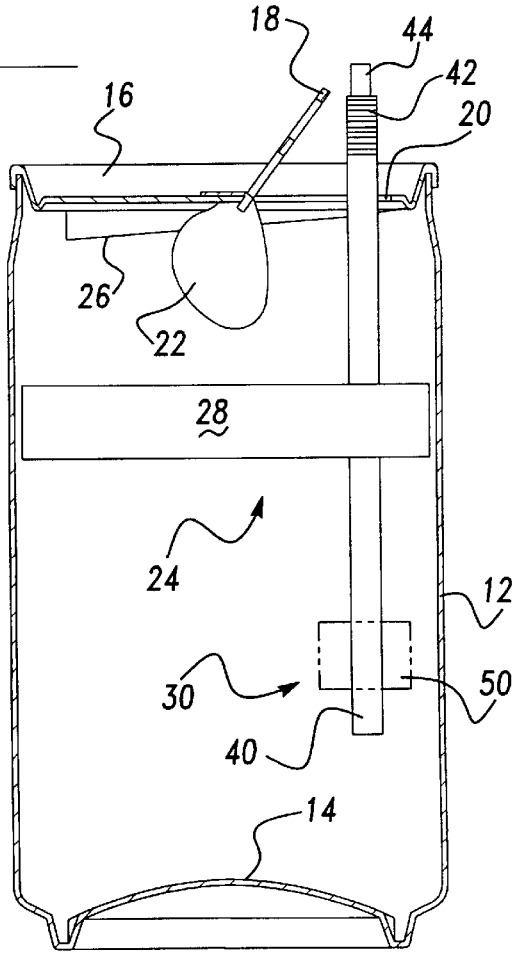
FIG. 2 is a vertical sectional view of the beverage can shown in FIG. 1 illustrating the straw ascending through the orifice in the lid of the can.
Figure 3:
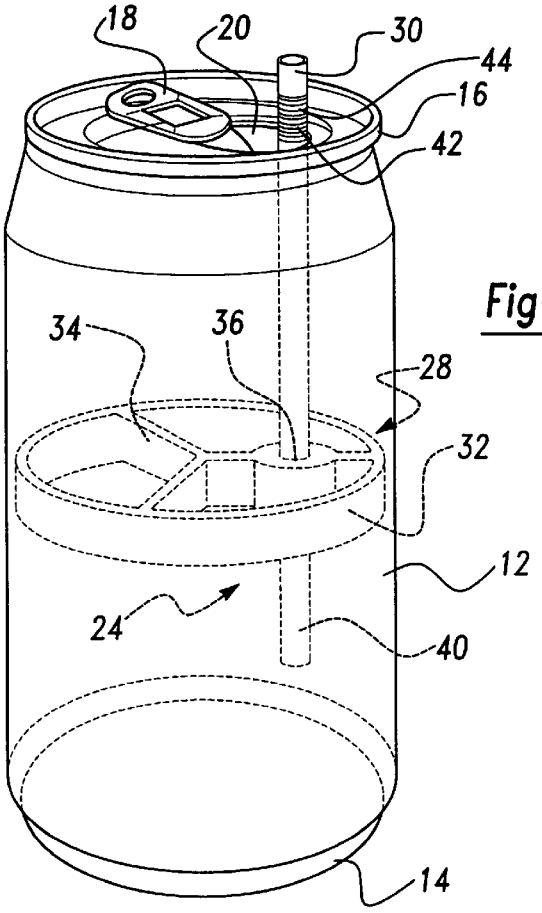
FIG. 3 is a front perspective view of the beverage can shown in FIGS. 1 and 2 illustrating the straw in the extended position.

Referring now to the drawings in which like reference numerals designate like or corresponding parts throughout the several views, there is shown in FIGS. 1–3 a beverage can having a straw dispensing mechanism in accordance with the present invention which is designated generally by reference numeral 10. Beverage can 10 comprises an aluminum, steel or plastic container having a cylindrical body 12 with a closed bottom 14 and an upper lid 16. Lid 16 is joined to body 12 using a seaming operation as is well known in the art. Lid 16 includes an actuating member or lever ring 18 pivotally secured to lid 16. Lever ring 18 is adapted when actuated to open an orifice 20 in lid 16 by deflecting a closure tab 22 into the interior of beverage can 10. Closure tab 22 is formed by score lines in lid 16 which enable a controlled portion of closure tab 22 to break free from lid 16 when lever ring 18 is actuated against tab 22 by an individual. As the user lifts one end of ring 18 to its maximum extent, the opposite end pushes against closure tab 22. Alternatively, the tab could be designed to brake free when depressed by the user's finger or by the use of a portable tool. In these types of closure tabs, lever ring 18 may be omitted. Closure tab 22 is typically designed via the score lines to deflect downwardly and toward one side of orifice 20 to fully open orifice 20 and facilitate the free flow of liquid from beverage can 10 through orifice 20.

Beverage can 10 further comprises a straw dispensing mechanism 24 which is comprised of a contoured or cam surface 26 located on the inside of lid 16, a buoyant member or float 28 and a drinking straw 30. Contoured or cam surface 26 is formed by lid 16 and is angled towards orifice 20 in order to guide straw 30 into alignment with orifice 20. Surface 26 may be formed into lid 16 with the reverse of the contoured surface being located on the top surface of lid 16 if desired or contoured surface 26 may be formed by a separate insert placed within beverage can 10.

Buoyant member 28 is manufactured from a material which will float within the liquid contained inside beverage can 10 and thus provide sufficient buoyant force (when liquid is present in beverage can 10) to cause straw 30 to be urged against contoured surface 26 and eventually to ascend through orifice 20 in can lid 16 when straw 30 is in alignment with orifice 20.

Buoyant member 28 is a circular member which includes an outer ring 32, a plurality of ribs 34 and a straw aperture 36. Outer ring 32 is an annular member which has an outer surface which is sized slightly smaller than the internal diameter of can body 12. Thus, outer ring 32 is free to move axially within beverage can 10. The height of outer ring 32 is sized to work in conjunction with straw 30 to limit the tilting of outer ring 32 in order to maintain straw 30 in a generally vertical position as shown in the drawings. The plurality of ribs 34 extend inwardly from outer ring 32 to meet at the center defined by outer ring 32. Ribs 34 provide rigidity to outer ring 32 and while three ribs 34 are shown in FIGS. 1–3, any suitable number of ribs may be utilized. During filling of beverage can 10, the plurality of ribs 34 permit filling of the volume of beverage can 10 located below buoyant member 28. One of the plurality of ribs 34 forms straw aperture 36. The radial positioning of aperture 36 along rib 34 positions aperture 36 in direct alignment with orifice 20 when aperture 36 is circumferentially aligned with orifice 20.

Drinking straw 30 includes a lower tubular portion 40, a pull-out flexible convoluted section 42 and an upper tubular portion 44. Lower tubular portion 40 of drinking straw 30 extends through aperture 36 in buoyant member 28. Aperture 36 frictionally receives straw 30 such that vertical movement of buoyant member 28 within beverage can 10 causes vertical movement of straw 30. Alternatively, a buoyant member 50 (shown in phantom in FIG. 2) may be attached to straw 30 or straw 30 can be manufactured from a buoyant material to provide the necessary buoyancy to straw 30.

FIG. 1 illustrates beverage can 10 and straw dispensing mechanism 24 immediately after the filling and seaming operation have been performed. Drinking straw 30 extends from bottom 14 of can body 12 vertically upward through aperture 36 of buoyant member 28 towards lid 16. The circumferential positioning of straw 30 in relation to orifice 20 occurs randomly due to the filling and seaming processes for beverage can 10. To prevent buoyant member 28 from elevating straw 30 during the can filling and seaming processes, and thus possibly interfering with these processes, a small amount of soluble adhesive 46 such as glucose or thixotropic gel, is preferably applied to temporarily bond straw 30 to can body 12 or closed bottom 14. Accordingly, after the filling and seaming processes are complete, adhesive 46 will gradually dissolve and thereby enable buoyant member 28 and straw 30 to float freely upward until straw 30 contacts contoured surface 26 on the underside of lid 16. During the subsequent handling of beverage can 10, straw 30 will react with contoured surface 26 to rotate buoyant member 28 and straw 30 until it is aligned with orifice 20 as shown in phantom in FIG. 1. The reaction between straw 30 and contoured surface 26 occurs due to the buoyant force exerted on straw 30 by buoyant member 28. Straw 30 will have a tendency to align with orifice 20 due to the ramping of contoured surface 26 towards orifice 20 regardless of the direction of rotation of buoyant member 28.

FIG. 2 illustrates beverage can 10 and straw dispensing mechanism 24 after lever ring 18 has pushed closure tab 22 into the interior of beverage can 10 to open orifice 20. Depending on the circumferential position of straw 30, in relation to orifice 20, the opening of orifice 20 may or may not result in contact between closure tab 22 and straw 30. Any contact between closure tab 22 and straw 30 will cause rotation of buoyant member 28 and straw 30 to slightly misalign straw 30 with orifice 20. This misalignment will be corrected once closure tab 22 is completely deflected to fully open orifice 20 by the interaction between straw 30 and contoured surface 26 as detailed above. Once straw 30 is aligned with orifice 20, the buoyant force on buoyant member 28 will push straw 30 upward through orifice 20 to provide accessibility to straw 30 for the user of beverage can 10.

At this point, the user may elect to commence drinking through straw 30 or withdraw straw 30 further through orifice 20 in lid 16. Buoyant member 28 is formed with sufficient rigidity and the frictional interface between straw 30 and aperture 36 of buoyant member 28 is sufficiently low to permit straw 30 to be pulled upward through buoyant member 28 as buoyant member 28 is held against the underside of lid 16. Convoluted section 42 can be extended regardless of whether or not straw 30 extends through aperture 36, to allow the user to extend the length of straw 30 so that the other end of straw 30 reached fully to the bottom 14 of beverage can 10 while upper portion 44 remains accessible through orifice 20.

Figure 3A:
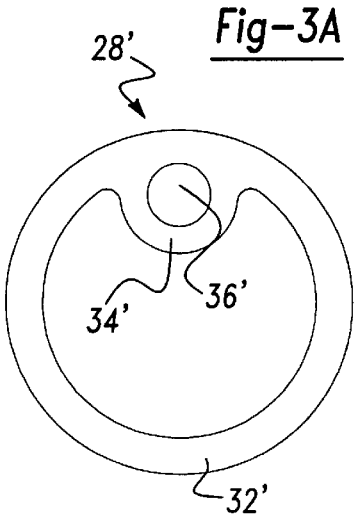
FIG. 3A is a plan view of a buoyant member in accordance with another embodiment of the present invention.

FIG. 3A illustrates a buoyant member 28' in accordance with another embodiment of the present invention. Buoyant member 28' comprises an outer ring 32', a radially inwardly disposed embossment 34' and a straw aperture 36'. Buoyant member 28' is a direct replacement for buoyant member 28.

Figure 4:
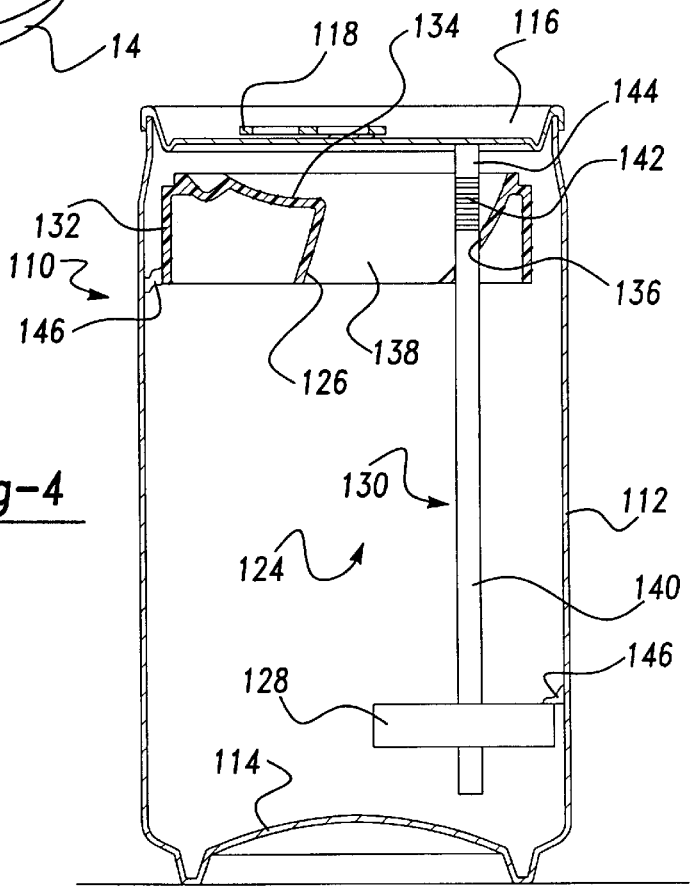
FIG. 4 is a vertical sectional view of a beverage can containing a straw-dispensing mechanism according to a second embodiment of the present invention.
Figure 5:
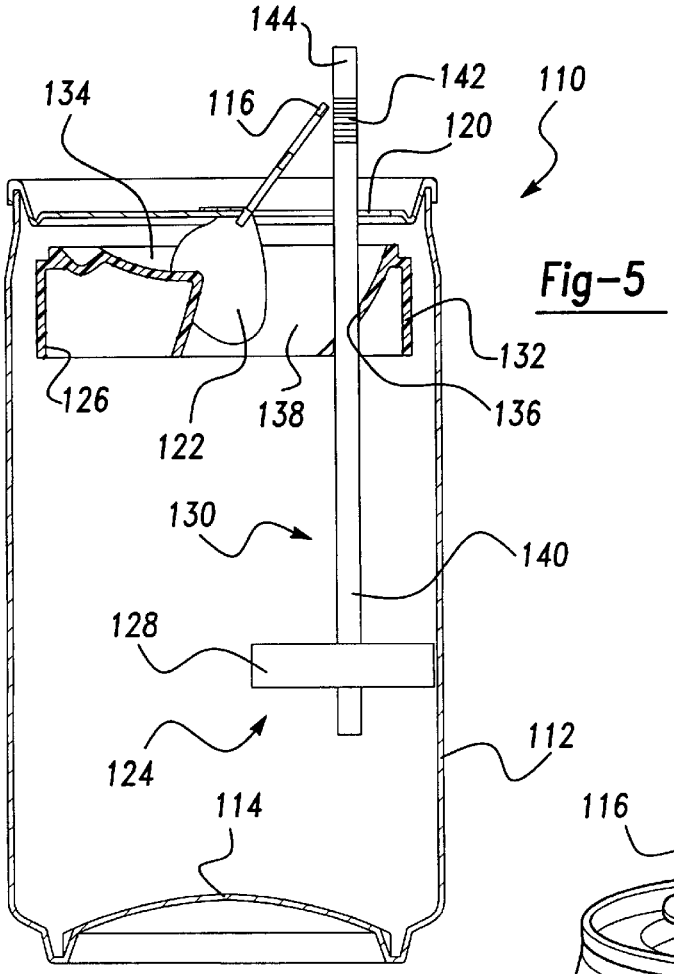
FIG. 5 is a vertical sectional view of the beverage can as shown in FIG. 4 illustrating the straw ascending through the orifice in the lid of the can.
Figure 6:
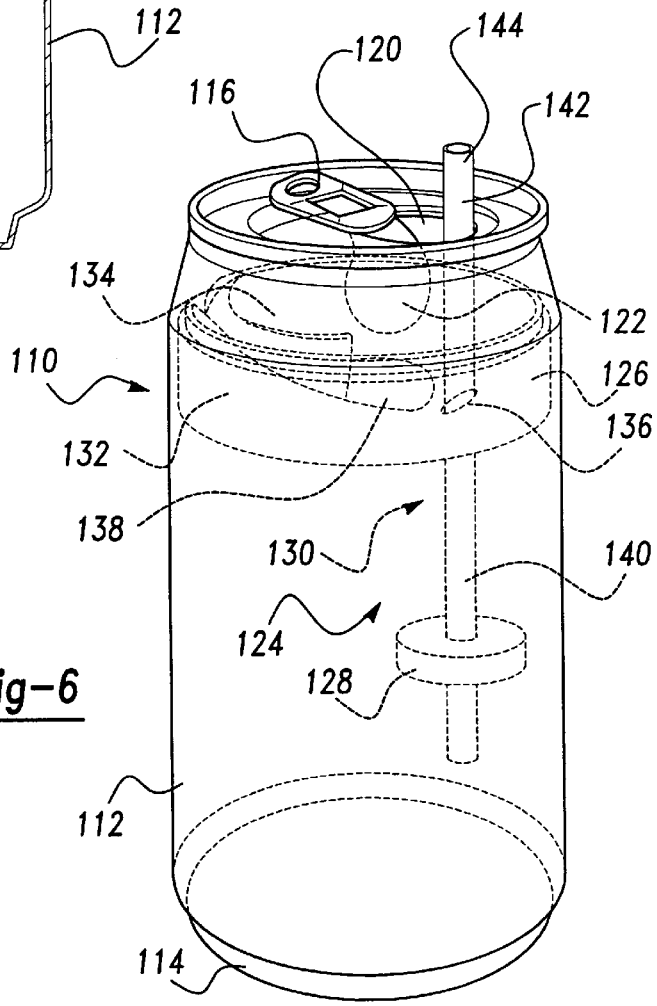
FIG. 6 is a front perspective view of the beverage can shown in FIGS. 4 and 5.

Referring now to FIGS. 4 through 6 there is shown a beverage can having a straw dispensing mechanism in accordance with another embodiment of the present invention which is designated generally by reference numeral 110. Beverage can 10 comprises an aluminum, steel or plastic container having a cylindrical body 112 with a closed bottom 114 and an upper lid 116. Lid 116 is joined to body 112 using a seaming process as is well known in the art. Lid 116 includes an actuating member or lever ring 118 pivotally secured to lid 116. Lever ring 118 is adapted when actuated to open an orifice 120 in lid 116 by deflecting a closure tab 122 into the interior of beverage can 110. Closure tab 122 is formed by score lines in lid 116 which enable a controlled portion of closure tab 122 to break free from lid 116 when lever ring 118 is actuated against tab 122 by a user. As the user lifts one end of ring 118, the opposite end pushes against closure tab 122. Alternatively, the tab could be designed to break free when depressed by the user's finger or by the use of a portable tool. IN these types of closure tabs, lever ring 18 may be omitted. Closure tab 122 is typically designed via the score lines to deflect downwardly and towards one side of orifice 120 to fully open orifice 120 and facilitate the free flow of liquid from beverage can 110 through orifice 120.

Beverage can 110 further comprises a straw dispensing mechanism 124 which is comprised of a floating member 126, a buoyant member 128 and a drinking straw 130. Floating member 126 defines an outer cylindrical surface 132, a contoured or cam surface 134 and a straw aperture 136.

Floating member 126 is manufactured from a material which will float within the liquid contained inside beverage can 110 and thus will position itself adjacent to lid 116 in a filled beverage can 110. Outer cylindrical surface 132 of floating member 126 is sized slightly smaller than the internal diameter of can body 112. Thus, floating member 126 is free to move axially within beverage can 110 and will be urged against lid 116 due to the buoyant force acting on floating member 126. The height of surface 132 is chosen to work in conjunction with straw 130 to limit the tilting of floating member 126 in order to maintain straw 130 in a generally vertical position as shown in the drawings. Aperture 136 extends vertically through floating member 126. The radial positioning of aperture 136 positions aperture 136 in direct vertical alignment with orifice 120 when aperture 136 is circumferentially aligned with orifice 120. A centrally located aperture 138 allows for the filling of the volume of beverage can 110 located below floating member 126. Alternatively, additional passages through floating member 126 or the clearance between floating member 126 and the interior of can body 112 may be used to facilitate the filling of beverage can 110.

Drinking straw 130 includes a lower tubular portion 140, a pull-out flexible convoluted section 142 and an upper tubular portion 144. Lower tubular portion 140 of drinking straw 130 extends through aperture 136 in floating member 126. Aperture 136 is slightly larger than lower tubular portion 140 and thus slidingly receives lower tubular portion 140. Thus, floating member 126 is free to move vertically within beverage can 110 with respect to straw 130. Buoyant member 128 is attached to the lower end of lower tubular portion 140 to urge straw 130 in an upward direction. The diameter of buoyant member 128 is chosen such that when the outer edge of buoyant member 128 is in contact with the inside wall of can body 112, straw 130 is positioned generally vertically within beverage can 110. Thus, buoyant member 128 will act as a torque arm to reduce the amount of tilting of floating member 126 during the opening of beverage can 110 as will be described later herein.

FIG. 4 illustrates beverage can 110 and straw dispensing mechanism 124 immediately after the filling and seaming operation have been performed. Drinking straw 130 extends from bottom 114 of can body 112 vertically upward through aperture 136 of floating member 126 towards lid 116. The circumferential positioning of straw 130 in relation to orifice 120 (FIG. 5) occurs randomly due to the filling and seaming processes for beverage can 110. To prevent floating member 126, buoyant member 128 and straw 30 from elevating during the can filling and seaming processes, and thus possibly interfering with these processes, a small amount of soluble adhesive 146, such as glucose or thixotropic gel, is preferably applied to temporarily bond floating member 126 and buoyant member 128 to can body 112. Another option would be to locate floating member 126 toward the bottom 114 of can body 112. Floating member 126 would then retain both buoyant member 128 and straw 130 within beverage container 110. In addition, the location of floating member 126 toward the bottom of can body 112 would minimize the volume of beverage can 110 located below floating member 126 to simplify the filling operation. Accordingly, after the filling and seaming processes are complete, adhesive 146 will gradually dissolve and thereby enable floating member 126 to float upwardly to be urged against lid 116 and enable buoyant member 128 and straw 130 to float freely upward until straw 130 contacts lid 116 as shown in FIG. 4. The circumferential positioning of straw 130 in relation to orifice 120 occurs randomly due to both the filling and seaming processes and any rotation which may occur as floating member 126 moves upward from its retained position during filling to its position shown in FIG. 4.

FIG. 5 illustrates beverage can 110 and straw dispensing mechanism 124 after lever ring 118 has pushed closure tab 122 into the interior of beverage can 110 to open orifice 120. The deflection of closure tab 122 from its closed (generally horizontal) position as shown in FIG. 4 to its open (generally vertical) position as shown in FIG. 5 results in engagement between closure tab 122 and floating member 126 which imparts rotational movement to floating member 126, buoyant member 128 and straw 130. Floating member 126 will rotate until straw 130 is aligned with open orifice 120. When straw 130 is aligned with orifice 120, buoyant member 128 will push straw 130 upward through orifice 120 to provide accessibility to straw 130 by the user of beverage can 110.

At this point, the user may elect to commence drinking through straw 130 or withdraw straw 130 further from its orifice 120 in lid 116. Buoyant member 128 is formed with sufficient flexibility and the interface between straw 130 and buoyant member 128 will release is sufficiently strong to retain buoyant member 128 on straw 130 when straw 130 is pulled upward causing straw 130 and buoyant member 128 to pass through floating member 126. Alternatively, the buoyant member can be designed to separate from straw 30. This would require the size of he float to be such that it would not pass through orifice 120 or aperture 138. Convoluted section 142 can be extended regardless of whether or not straw 130 extends through aperture 136, to allow the user to reach fully to bottom 114 of beverage can 110.

Figure 7:
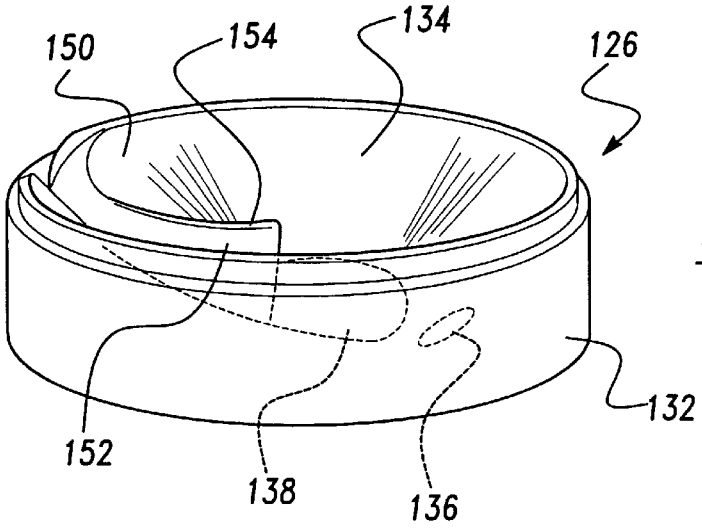
FIG. 7 is a perspective view of the floating disk shown in FIGS. 4–6.
Figure 8:
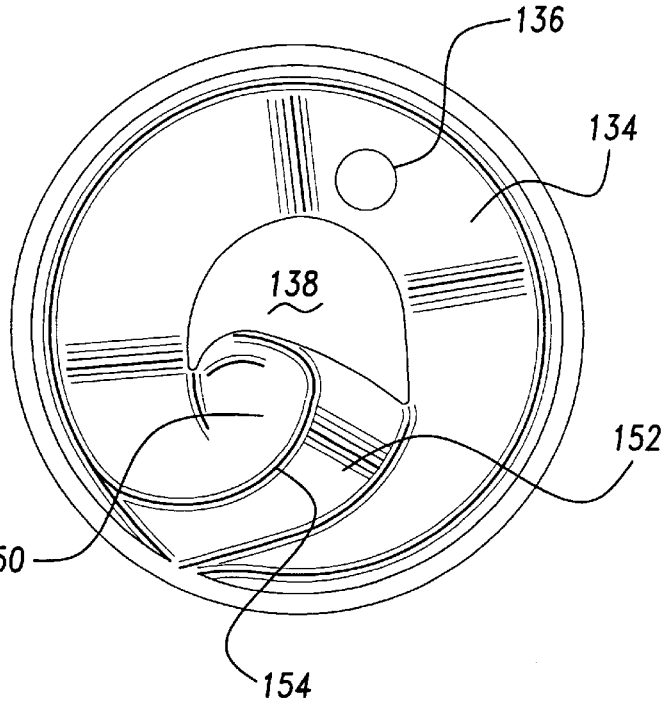
FIG. 8 is a plan view of the floating disk shown in FIG. 7.
Figure 9:
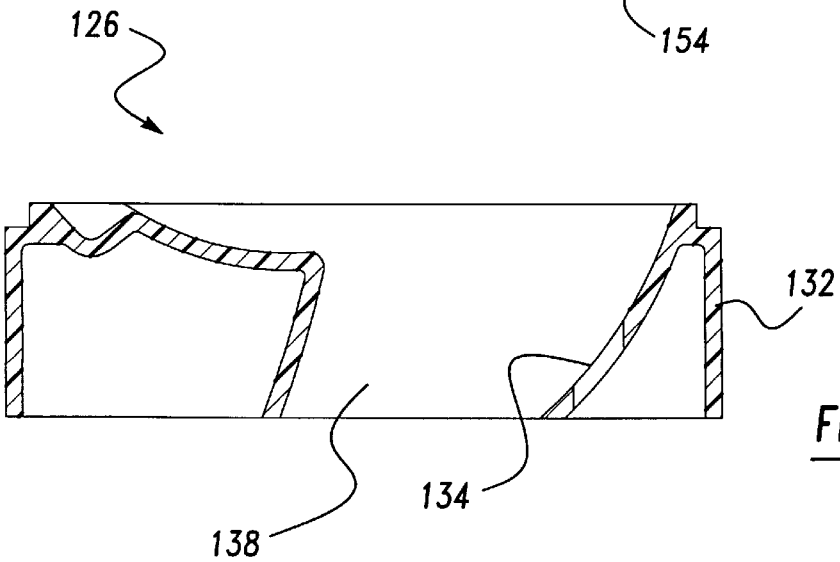
FIG. 9 is a vertical sectional view of the floating disk shown in FIGS. 7 and 8.

Referring now to FIGS. 7–9, floating member 126 is illustrated. Floating member 126 includes outer cylindrical surface 132, contoured or cam surface 134, straw aperture 136 and central aperture 138 as detailed above. Cam surface 134 defines a first contoured surface 150 and a second contoured surface 152. Contoured surfaces 150 and 152 form a bidirectional cam surface which will rotate floating member 126 clockwise or counterclockwise depending on whether contoured surface 150 or contoured surface 152 is engaged by closure tab 122 (FIG. 5). The incorporation of contoured surface 150 and contoured surface 152 limits the maximum amount of rotation of floating member 126 to 180° in order to align straw 130 with orifice 120 (FIG. 5). A ridge 154 separates contoured surface 150 from contoured surface 152 at one end while the opposite ends of surfaces 150 and 152 blend together as shown in the drawings.

During the opening of beverage can 110 closure tab 122 engages either contoured surface 150 or 152 to impart rotational movement to floating member 126, buoyant member 128 and straw 130. In order to ensure rotational movement of floating member 126 and to avoid excessive tipping of floating member 126, straw 130 and buoyant member 128 may act as a torque arm to stabilize floating member 126 and limit the amount of its tipping. As detailed above, the diameter of buoyant member 128 is chosen such that when the outer circumferential edge of buoyant member 128 is in contact with the inside wall of can body 112, straw 130 is positioned generally vertically within beverage can 110. Any tilting of floating member 126 will be resisted by straw 130 and buoyant member 128 acting between the sidewall of can body 112 and the interior surface of aperture 136 of floating member 126. The use of straw 130 and buoyant member 128 as a torque arm allows for the shortening of the overall height of cylindrical surface 132 of floating member 126.

While the above detailed description describes the preferred embodiment of the present invention, it should be understood that the present invention is susceptible to modification, variation and alteration without deviating from the scope and fair meaning of the subjoined claims.

What is claimed is:

1. A beverage container comprising:

a body with a closed bottom end and a top end;

a lid closing said top end of said body, said lid defining an orifice;

a closure tab disposed within said orifice;

a floating member disposed within said body, said floating member being urged against said lid when a liquid is disposed within said container;

a straw associated with said floating member; and means for deflecting said closure tab into said container to open said orifice, said closure tab engaging said floating member to move said floating member and thereby align said straw with said orifice.

2. The beverage container according to claim 1 wherein, said engagement between said floating member and said closure tab causes rotational movement of said floating member.

3. The beverage container according to claim 2 wherein, said floating member defines an aperture, said straw being slidingly received within said aperture.

4. The beverage container according to claim 3 further comprising a buoyant member associated with said straw, said buoyant member elevating said straw through said orifice when said straw is aligned with said orifice.

5. The beverage container according to claim 4 wherein, said buoyant member contacts said can body to limit tilting of said floating member during engagement of said closure tab with said floating member.

6. The beverage container according to claim 1 wherein, said floating member defines an aperture, said straw being slidingly received within said aperture.

7. The beverage container according to claim 6 further comprising a buoyant member attached to said straw, said buoyant member elevating said straw through said orifice when said straw is aligned with said orifice.

8. The beverage container according to claim 1 further comprising means for temporarily securing said floating member to said body.

9. The beverage container according to claim 1 wherein, said floating member includes a surface for engaging said body.

10. The beverage container according to claim 1 wherein, said floating member defines a contoured surface for engagement with said closure tab.

11. The beverage container according to claim 1 wherein, said floating member defines a first and a second contoured surface for engagement with said closure tab.

12. The beverage container according to claim 11 wherein, said engagement between said closure tab and said first contoured surface causes clockwise rotation of said floating member and engagement between said closure tab and said second contoured surface causes counterclockwise rotation of said floating member.

13. The beverage container according to claim 12 wherein, said floating member defines an aperture, said straw being slidingly received within said aperture.

14. The beverage container according to claim 13 further comprising a buoyant member associated with said straw, said buoyant member elevating said straw through said orifice when said straw is aligned with said orifice.

15. The beverage container according to claim 1 wherein, said engagement between said floating member and said closure tab causes rotational movement of said floating member.

16. The beverage container according to claim 1 wherein, said floating member includes a surface for engaging said body.

* * * * *